US006918780B1

(12) United States Patent
Yang

(10) Patent No.: US 6,918,780 B1
(45) Date of Patent: Jul. 19, 2005

(54) SNAP FASTENER FOR ELECTRICAL SOCKET

(75) Inventor: Po-Cheng Yang, Taoyuan Hsien (TW)

(73) Assignee: Exito Electronics Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/846,532

(22) Filed: May 17, 2004

(30) Foreign Application Priority Data

Apr. 21, 2004 (TW) ..... 93206113 U

(51) Int. Cl.[7] ..... H01R 13/625

(52) U.S. Cl. ..... 439/346; 439/783; 439/833; 439/863; 439/807

(58) Field of Search ..... 439/346, 783, 439/807, 833, 863

(56) References Cited

U.S. PATENT DOCUMENTS 5,941,724 A * 8/1999 Reed ..... 439/346
6,428,339 B1 * 8/2002 Davidson et al. ..... 439/346

* cited by examiner

*Primary Examiner*—Truc Nguyen
(74) *Attorney, Agent, or Firm*—Troxell Law Office, PLLC

(57) ABSTRACT

A snap fastener for the electrical socket comprises a housing, a receptacle and snap fastener. When the knob of the snap fastener is being turned, the downward hump of the knob will drive the bulge of the brake plate to rotate and finally fall into the bottom recess of the brake plate and the fork of the brake plate will move downward to clamp the electrical blades of the plug in place. When the knob is turned in the reverse direction, the bulge of the snap will rise from the recess and push upward the fork of the brake plate, so the electrical blades of the plug get loose and are easy to leave the socket. Or a screw shank is used instead of the snap to move down or up the brake plate by turning the knob only.

2 Claims, 9 Drawing Sheets

SNAP FASTENER FOR ELECTRICAL SOCKET

BACKGROUND OF THE INVENTION

1. Field of the Invention

This invention relates to a novel snap fastener for socket, which is to fasten the electrical blades of the plug in the socket to ensure the good connection of electrical current and prevent the electrical plug from falling off the socket incidentally.

2. Description of the Related Art

In general practice, the prior art of the plug and socket are the critical apparatus to link to power supply. Unfortunately, the plug and the socket are not firmly clamped together, easy to fall apart, just like a power outage, all data that have been collected or entered are lost suddenly.

That is because the prior art of the plug and the socket are not provided with a snap fastener. The inventor has been in this industrial field for years and has advocated great efforts to the improvement and come up this snap fastener to fulfill the expected result.

SUMMARY OF THE INVENTION

The major object of this invention is to provide a snap fastener for socket to hold the electrical blades of the plug in place when the plug is inserted, not easy to fall off and no interruption of power supply.

DETAILED DESCRIPTION OF THE INVENTION

Figure 1:
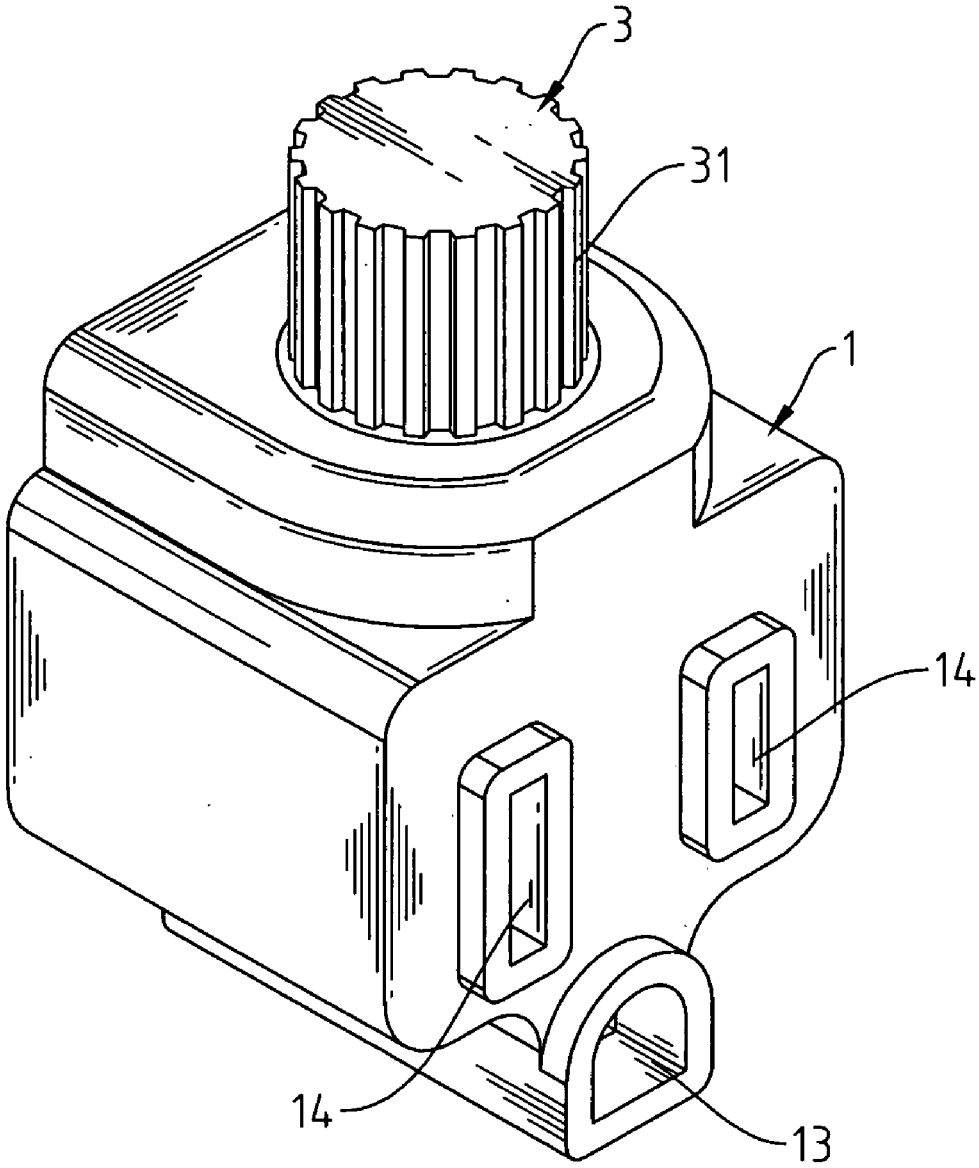
FIG. 1 shows the solid appearance of the snap fastener for socket of this invention.

The features and advantages of this invention are explained in great detail with the aid of preferable embodiments as illustrated in the drawings attached.

Figure 2:
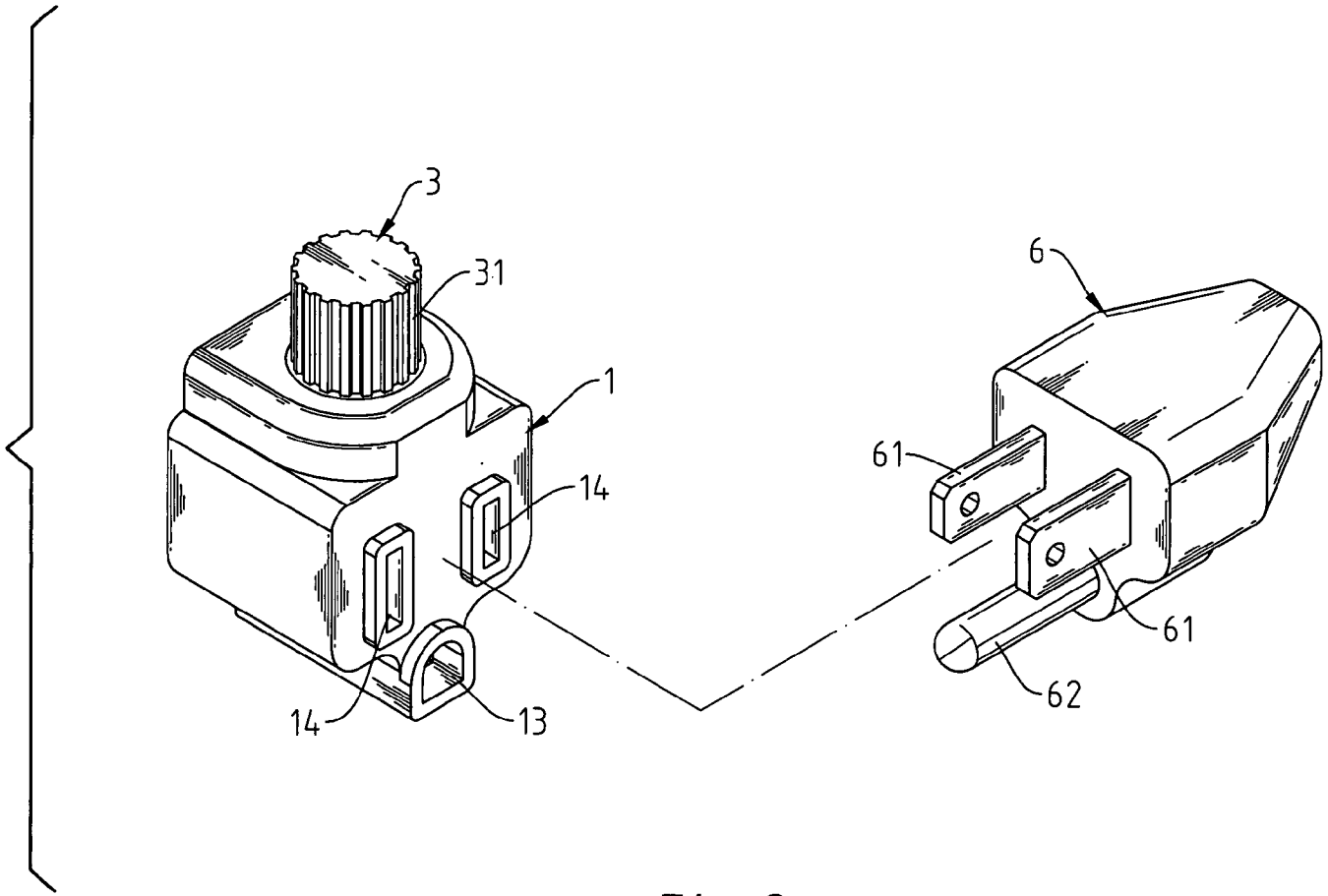
FIG. 2 shows an elevation pertaining to the relationship of socket and plug.
Figure 3:
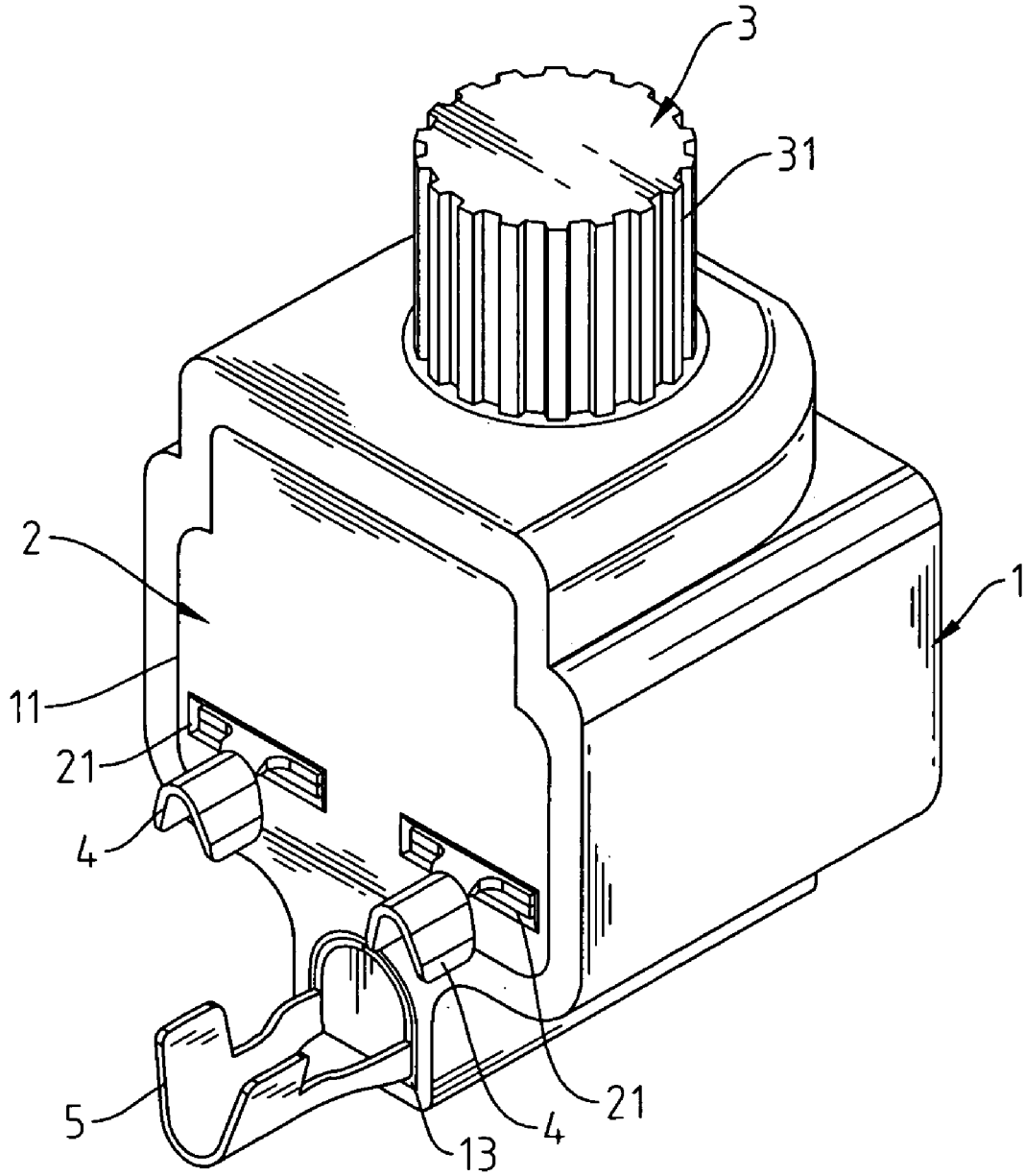
FIG. 3 shows the solid appearance of the snap fastener for socket of this invention viewed from different angle.

Please refer to FIGS. 1 through 3, the snap fastener for the socket as provided in this invention at least includes a housing 1, a receptacle 2 and a snap fastener 3, in which the housing 1 has an opening 12 on the top and two slots 14 and a ground slot 13 in triangular opposition in the front. The ground slot 13 will receive the connector 5. The housing 1 has a cavity 11 to accept the receptacle 2.

Figure 4:
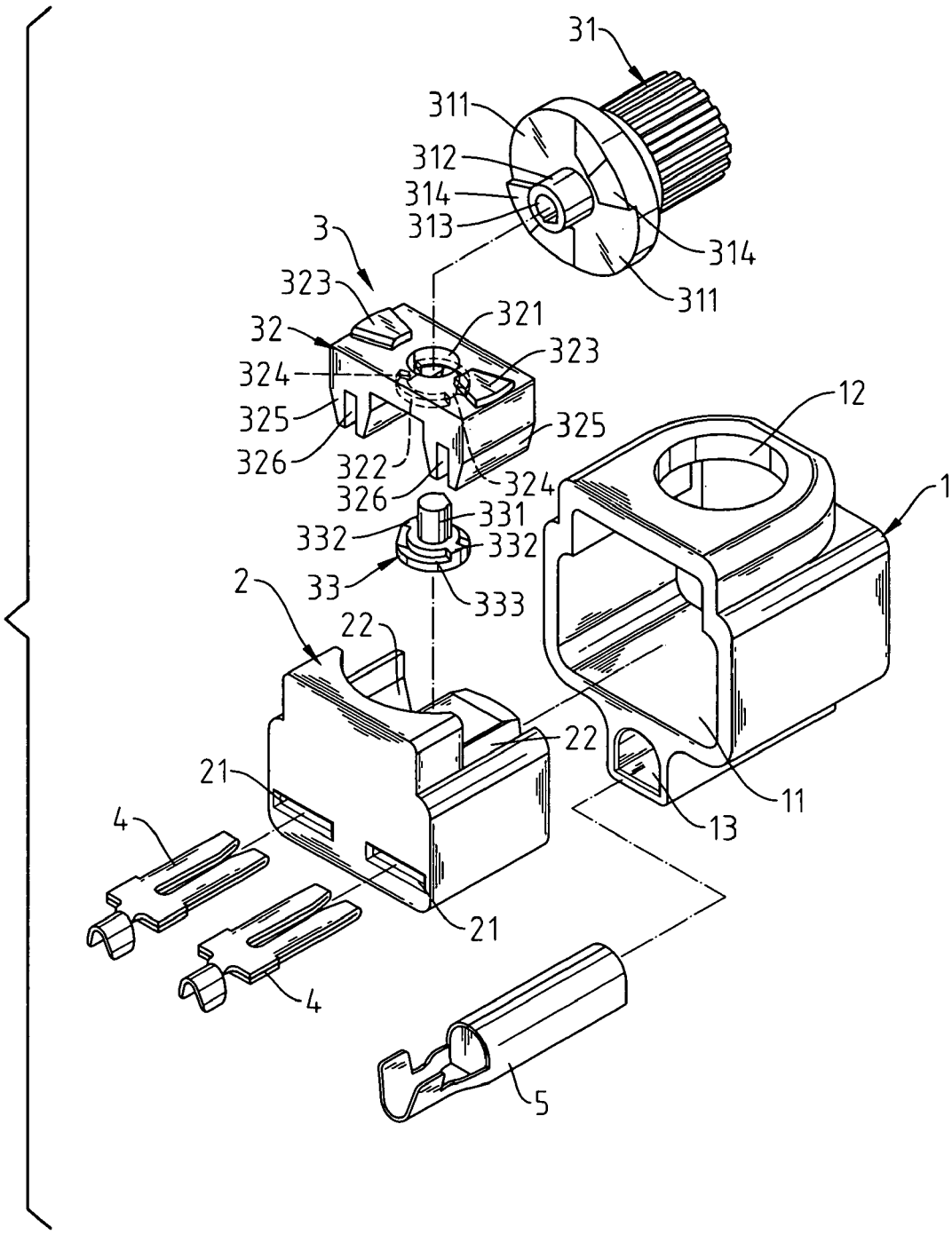
FIG. 4 shows the solid disassembly of the snap fastener for socket of this invention.
Figure 5:
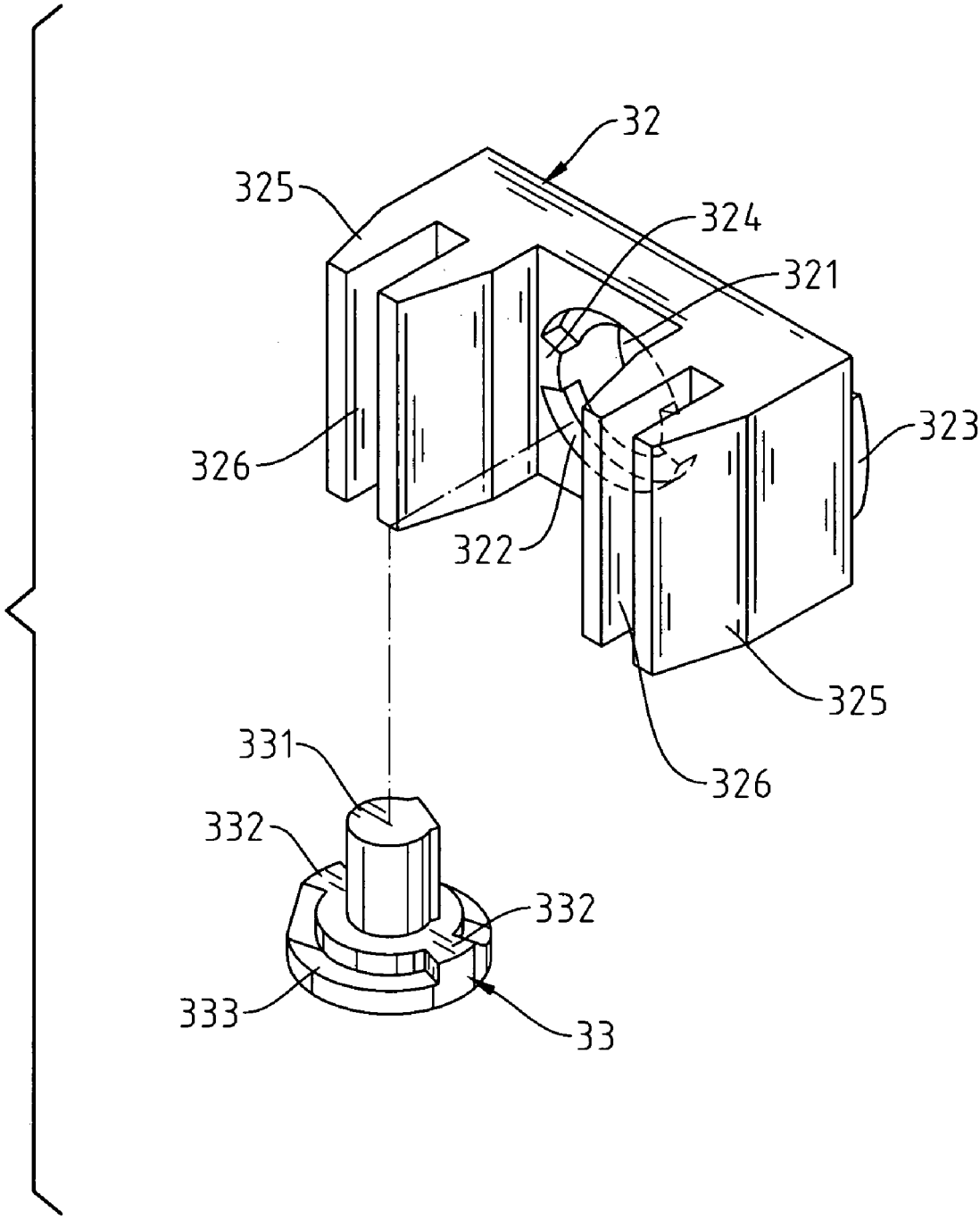
FIG. 5 shows the solid disassembly of the snap fastener of this invention.

As shown in FIGS. 2, 4 and 5, the receptacle 2 is mounted in the cavity 11 of the housing 1. The receptacle 2 has two terminal slots 21 linking with two slots 14 and terminal blades 4. Above the terminal blades 4, there are two V form grooves 22 to receive the electrical blades 61 of the plug 6 overlapped on the terminal blades 4.

The snap fastener 3 rides over the V grooves 22 of the receptacle 2. The snap fastener 3 consists of a knob 31, a brake plate 32 and a snap 33. The brake plate 32 has two fork legs 325 and inward recessed trench 326. The brake plate 32 has two bulges 323 on the top and two flutes 322 in symmetry under the axial hole 321 and two projections 324 besides the flute 322. The snap 33 is under the brake plate 32. The snap 33 is in a post form with a post 331. The snap 33 has an outward extended base with two slide grooves 333 and a projection 332 existing between the grooves 333. The post 331 of the snap 33 will pierce into the axial hole 321 and stops in the retaining hole 313 of the barrel 312 on the knob 31. When the retaining hole 313 is turned, the snap 33 will be turned too. The knob 31 is exposed to the outside f housing 1 through the top hole 12. The bottom of the knob has the barrel 312 with humps 314 and curved fan valleys 311 around the barrel 312.

As shown in FIGS. 2, 4 and 6 through 8, when the blades 61 of the plug 6 are inserted; the snap fastener 3 will hold the blades 61. When the knob 31 of the snap fastener 3 is turned, it drives the snap 33 into action.

Figure 6:
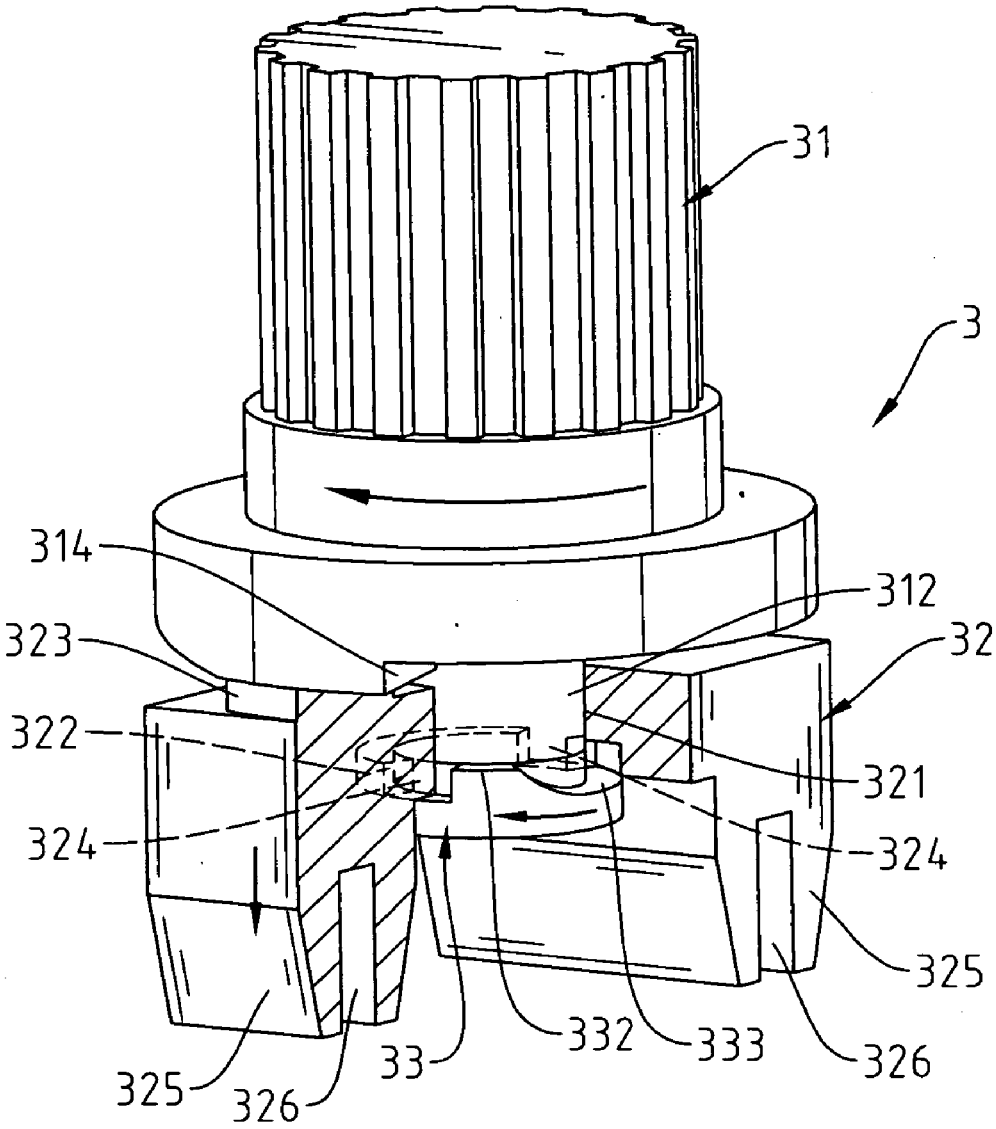
FIG. 6 shows the down movement of the snap fastener for socket of this invention.
Figure 8:
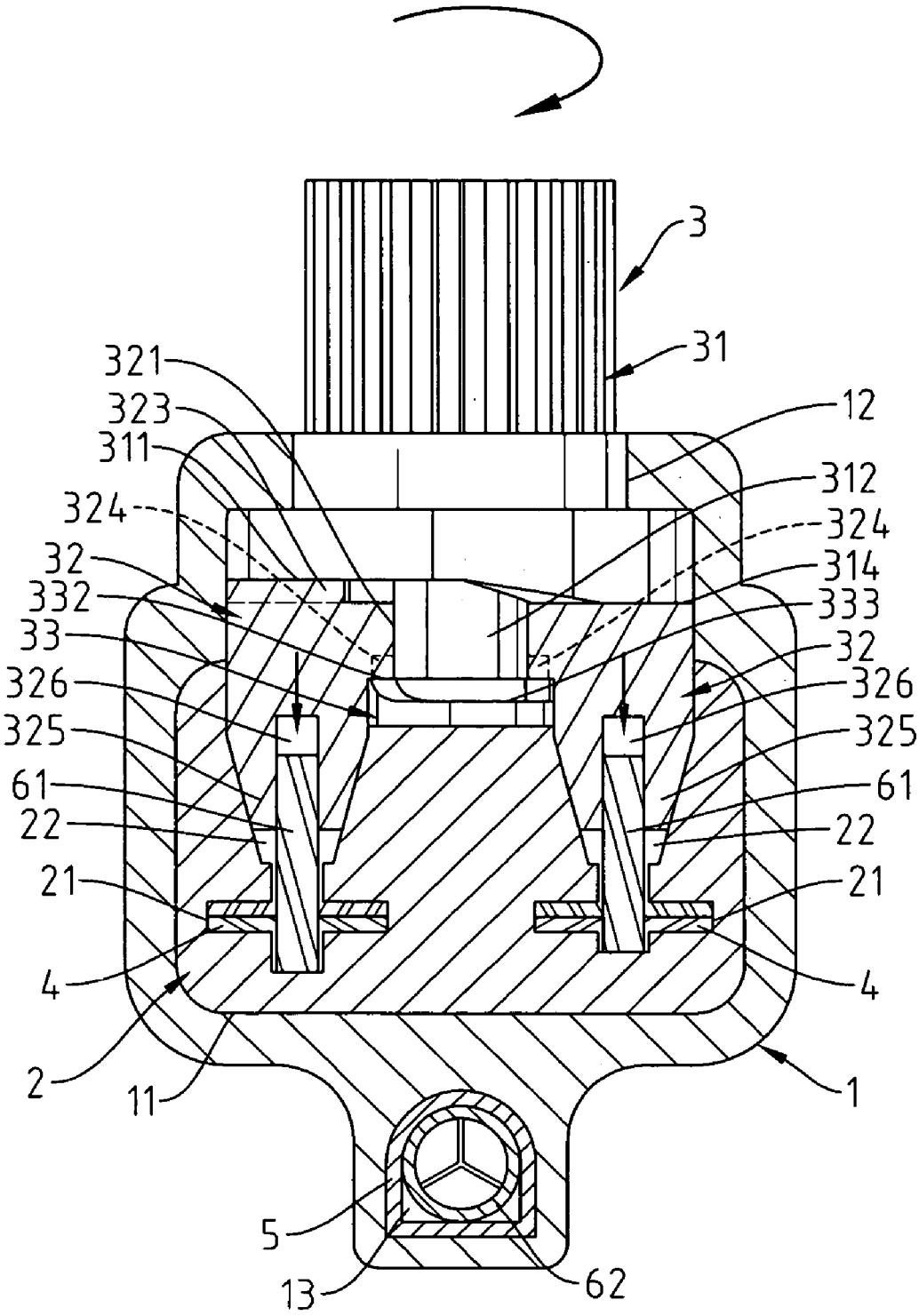
FIG. 8 shows the section of the snap fastener for socket of this invention.

As shown in FIGS. 6 and 8, when the knob 31 is being turned, the hump 314 compressing on the top of the bulge 323 of the brake plate 32 drives the snap 33 to rotate and the projection 332 will pass the bulge 324 and slides into the flute 322 beneath the brake plate 32. The curved fan valley 311 will move the brake plate 32 downward so the fork legs 325 and the trenches 326 will press and hold the electrical blades 61 of the plug 6.

Figure 7:
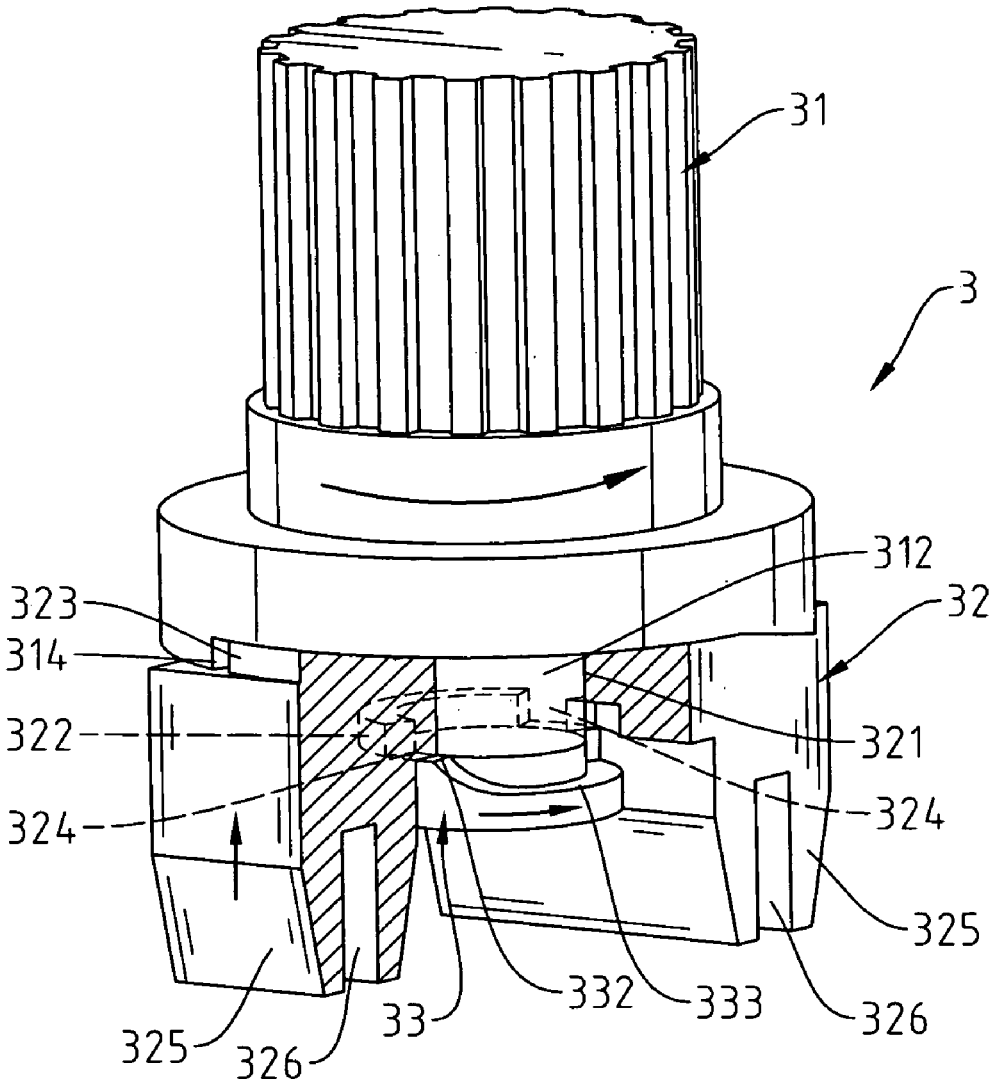
FIG. 7 shows the disengagement of the blades from the snap fastener of this invention.

As shown in FIG. 7, when the snap fastener 3 is turned in other direction, the snap the pair of projection 332 of the snap 33 will come out of the flute 322, pass the bulge 324, so the projection 332 will rise the brake plate 32 and the blades 61 of the plug 6 will get loose from the fork legs 325.

Figure 9:
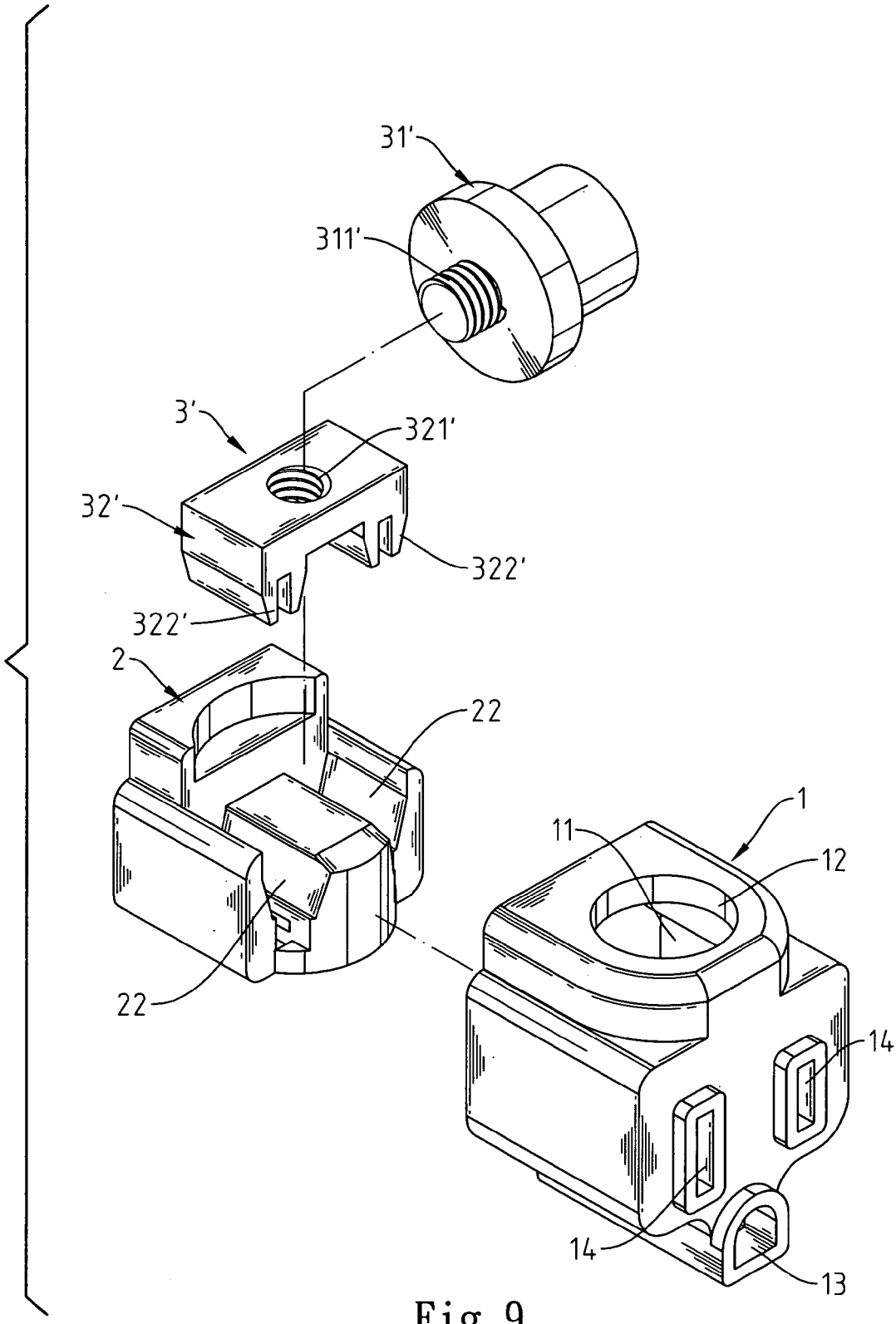
FIG. 9 shows another embodiment of the snap fastener for socket of this invention.

FIG. 9 shows another embodiment of the snap fastener of this invention in which the brake plate 32' is housed in the receptacle 2 and the fork leg 322' extends into the V groove 22. The shaft hole 321' receives the screw shank 311'. To truing the knob 31 will move down and up the brake plate 32' to lock up the blades 61.

The above statements prove that this novel snap fastener for the socket is justified for granting a patent. Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What the invention claimed is:

1. A snap fastener for a socket mainly comprises a housing, a receptacle and a snap fastener with a key characteristics as described below:

the housing has a top hole and a cavity to receive the receptacle;

the receptacle has a pair of terminal slots corresponding to a slot on the housing;

the receptacle has two V-grooves so two terminal blades are mounted therein;

the snap fastener includes a knob, a brake plate and a snap; the brake plate has two fork legs on a bottom and two bulges on a top; under a shaft hole, there are two flutes and two humps from between a flutes; a snap sits under the brake plate;

the snap has a post and two curved slide grooves and a projection on an extended base;

the post of the snap will pass the shaft hole of the brake plate and enter in a retaining hole of a barrel on the knob;

wherein when the retaining hole and barrel are turned, the post will be turned too; the bottom face of the knob has two curved fan valleys and two humps surrounding the barrel;

wherein after the snap fastener is installed in the housing and the knob is being turned, the hump of knob that pressing on the bulge of the brake plate will drive the projection of the snap to pass the bulge of the brake plate and fall into the flute under the shaft hole, the brake plate moves downward and the fork legs therefore press and hold a blade of a plug in place, in case the knob is turning in other direction, the pair of the projection on the snap will slide out the flute and raise the brake plate upward to loose the fork legs so the blades of the plug disengage socket.

2. The snap fastener for the socket as claimed in the claim 1 in which the knob is provided with a screw shank, which passes through the brake plate to move up down the fork legs of the brake plate so as to hold down in place, the blades of plug.

* * * * *